US006710521B2

(12) United States Patent
Tsuda et al.

(10) Patent No.: US 6,710,521 B2
(45) Date of Patent: Mar. 23, 2004

(54) DISCHARGE BULB WITH INFRARED TRANSMITTING FILM

(75) Inventors: Toshiaki Tsuda, Shizuoka (JP); Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 16 days.

(21) Appl. No.: 09/993,510

(22) Filed: Nov. 27, 2001

(65) Prior Publication Data

US 2002/0063503 A1 May 30, 2002

(30) Foreign Application Priority Data

Nov. 28, 2000 (JP) ..... 2000-360867

(51) Int. Cl.[7] ..... H01J 5/16; H01J 17/16
(52) U.S. Cl. ..... 313/113; 313/635
(58) Field of Search ..... 313/113, 110, 313/479, 112, 634, 635, 25

(56) References Cited

U.S. PATENT DOCUMENTS 4,949,005 A * 8/1990 Parham et al. ..... 313/112
5,587,626 A * 12/1996 Parham et al. ..... 313/634
5,610,469 A * 3/1997 Bergman et al. ..... 313/25
2001/0019482 A1 9/2001 Kobayashi et al. ..... 362/510

FOREIGN PATENT DOCUMENTS

JP 2001-229717 8/2001 ..... F21S/8/12

* cited by examiner

*Primary Examiner*—Vip Patel
*Assistant Examiner*—Joseph Williams
(74) *Attorney, Agent, or Firm*—Sughrue Mion, PLLC

(57) ABSTRACT

In a discharge bulb having an arc tube formed with pinch seal portions on both ends of a sealed glass bulb that is a light-emitting discharge section, infrared transmitting films for blocking visible light and transmitting infrared light are applied to at least the pinch seal portions of the arc tube to prevent visible light from exiting the pinch seal portions and to suppress generation of glare. Infrared light from the pinch seal portions can pass through the infrared transmitting films, which prevents accumulation of heat in the arc tube (pinch seal portions and sealed glass bulb), thereby preventing the temperature of the arc tube from increasing excessively.

19 Claims, 7 Drawing Sheets

DISCHARGE BULB WITH INFRARED TRANSMITTING FILM

BACKGROUND OF THE INVENTION

1. Field of the Invention

The present invention relates to a discharge bulb having an arc tube that is a sealed bulb acting as a light-emitting discharge section formed with pinch seal portions on both ends thereof.

2. Description of the Related Art

A conventional discharge bulb is illustrated in FIG. 9. A cylindrical shroud glass 3 having an ultraviolet blocking effect is integrally welded to an arc tube 1. The cylindrical shroud glass 3 covers pinch seal portions 1*a* and 1*b* and a sealed glass bulb 2 that is a light-emitting discharge section. The cylindrical shroud glass 3 is used, in part, to prevent broken pieces of the arc tube 1 from spreading as a result of an explosion, and to eliminate ultraviolet light in a wave-band that is harmful to human bodies and the like from the light emitted by the sealed glass bulb 2. The reference symbol "a" represents electrodes provided in a face-to-face relationship with the sealed glass bulb 2 as a light-emitting section, and the reference symbol "b" represents molybdenum foils sealed to the pinch seal portions 1*a* and 1*b*. The electrodes a and a and the lead wire c are connected to the molybdenum foil b.

The lead wire c extracted from the pinch seal portion 1*a* on the front end of the arc tube 1 is supported by a lead support 6 extending in front of an insulated base 5, and the rear end of the arc tube 1 is secured to the front side of the insulated base 5 with an adhesive 4 to integrate the arc tube 1 with the insulated base 5.

The symbol 10 represents a reflector for forming a meeting beam from, for example, a headlamp of an automobile, and symbol 9 represents a shade having a light-blocking section in a configuration adapted to an effective reflecting surface 10*a* of the reflector and is typically provided to guide light emitted by the sealed glass bulb 2 only to the effective reflecting surface 10*a*. The shade 9 also has a function of forming clear-cut lines of a luminous distribution pattern.

In the above-described conventional discharge bulb, since a very large quantity of light is emitted by the sealed glass bulb 2 compared to an incandescent light, a large quantity of light is also guided to the pinch seal portions because of a light-guide effect. For reasons including the fact that the molybdenum foils b that reflect light are normally provided on the pinch seal portions 1*a* and 1*b*, and that the surface configuration of the pinch seal portions is uneven, light can exit the pinch seal portions 1*a* and 1*b* and be reflected by the reflector 10 in the forward direction, which could result in glare.

SUMMARY OF THE INVENTION

In an intention to prevent light from exiting the pinch seal portions 1*a* and 1*b*, the inventors applied light-blocking films, that had generally been used for forming a luminous distribution, to the pinch seal portions 1*a* and 1*b* and to the shroud glass 3. However, using this technique, new problems arose in that an intended color temperature could not be achieved because of a large increase of the temperature of the pinch seal portions 1*a* and 1*b* and the sealed glass bulb 2, although light from the pinch seal portions 1*a* and 1*b* is prevented to some degree. In addition, the pinch seal portions 1*a* and 1*b* become likely to crack which reduces the durability of the arc tube. Further, the light-blocking films can come off because of the high temperature in their environment.

The inventors thought that the great increase in the temperature of the arc tube was attributable to the fact that the conventional light-blocking films for forming a luminous pattern blocked infrared light in addition to visible light to accumulate heat in the arc tube. Then, they thought that the accumulation of heat in the arc tube could be avoided by transmitting infrared light while blocking visible light. In experiments, the inventors confirmed that the above-described problems will not occur when infrared transmitting films for blocking visible light and transmitting infrared light are used as the light-blocking films to prevent the overheating of the pinch seal portions 1*a* and 1*b* and the sealed glass bulb 2, and accordingly, the present invention is being presented based on such a finding.

It is an object of the present invention to provide a discharge bulb that does not produce glare and that has excellent durability by applying infrared transmitting films for blocking visible light and transmitting infrared light to at least pinch seal portions of an arc tube.

In order to achieve the above-described object, a discharge bulb according to a first aspect of the invention includes an arc tube that is a sealed bulb, for example, a glass bulb, as a light emitting discharge section formed with pinch seal portions at both ends thereof, in which infrared transmitting films for blocking visible light and transmitting infrared light are applied to at least the pinch seal portions of the arc tube.

The infrared transmitting films prevent visible light from exiting the pinch seal portions, and therefore suppress generation of light that can result in glare.

Since the infrared transmitting films do not prevent infrared light from exiting the pinch seal portions, no heat is accumulated in the arc tube (in particular, the pinch seal portions and sealed glass bulb).

In a second aspect of the invention, the arc tube of the present invention may be provided in a lighting chamber of a vehicle front light lamp, and the infrared transmitting films may be applied in predetermined ranges extending from the bottom of the sealed glass bulb of the arc tube provided in the lighting chamber to left and right lateral surfaces thereof.

Since substances such as mercury and a metal halide may be enclosed in the sealed glass bulb in a saturated state, the enclosed substances may be deposited in a liquid state on the bottom of the sealed glass bulb. As a result, light exiting the sealed glass bulb downward becomes yellow light that is colored by the enclosed substances, and that light is mixed with white light that should be emitted by the sealed glass bulb, which is not preferable. The infrared transmitting films provided to extend from the bottom of the sealed glass bulb to left and right lateral surfaces thereof prevent the colored light (yellow light) from exiting the sealed glass bulb.

In a third aspect of the present invention, the discharge bulb may be an arc tube that has a sealed glass bulb as a light emitting discharge section formed with pinch seal portions on both ends thereof and a cylindrical shroud glass integrally joined, such as by welding, to the arc tube to enclose and seal the arc tube. Infrared transmitting films for blocking visible light and transmitting infrared light are applied to at least the pinch seal portions of the arc tube and/or at least regions of the shroud glass associated with the pinch seal portions.

The infrared transmitting films provided on the pinch seal portions of the arc tube and/or the shroud glass prevent visible light from exiting the pinch seal portions and prevent visible light that has exited the pinch seal portions from exiting the shroud glass, which suppresses generation of light that can result in glare.

The infrared transmitting films provided on the pinch seal portions of the arc tube and/or the shroud glass do not prevent infrared light from exiting the pinch seal portions and do not prevent infrared light that has exited the pinch seal portions from exiting the shroud glass, which prevents accumulation of heat in the arc tube (the pinch seal portions and sealed glass bulb).

Especially, when the infrared transmitting film is applied only to the shroud glass, accumulation of heat in the arc tube is less likely to occur than when the infrared transmitting film is applied to the pinch seal portions only or to both of the pinch seal portions and the shroud glass because the temperature of the shroud glass is lower than the temperature of the arc tube (pinch seal portions) when the discharge bulb is turned on.

When the infrared transmitting film is applied to both of the pinch seal portions and shroud glass, visible light is prevented from exiting two times, which reliably prevents generation of light that can result in glare.

Further, in a discharge bulb according to a fourth aspect of the present invention, the arc tube may be provided in a lighting chamber of a vehicle headlamp, and the infrared transmitting films are applied in predetermined ranges extending from the bottom of the sealed glass bulb of the arc tube provided in said lighting chamber to left and light lateral surfaces thereof and/or in predetermined ranges extending from the bottom of the shroud glass to left and right lateral surfaces thereof.

Since substances such as mercury and a metal halide are enclosed in the sealed glass bulb in a saturated state, the enclosed substances are deposited on the bottom of the sealed glass bulb in a liquid state. As a result, light exiting the sealed glass bulb downward becomes yellow light that is colored by the enclosed substances, and the light is mixed with white light that should be emitted by the sealed glass bulb, which is not preferable. The infrared transmitting film on the bottom of the sealed glass bulb and/or the bottom of the shroud glass prevents the colored light (yellow light) from exiting the sealed glass bulb and/or shroud glass.

In a fifth aspect of the invention, the discharge bulb may be used as a light source of a reflection type headlamp for forming a predetermined luminous distribution with light reflected by a reflector provided behind the same. Infrared transmitting films to serve as linear light-blocking sections for forming clear-cut lines of the luminous distribution pattern are applied to left and right lateral surfaces of the shroud glass.

Since clear-cut lines of a luminous distribution pattern are formed by the linear light-blocking sections extending before and behind the infrared transmitting films applied to the left and right lateral surfaces of the shroud glass form clear-cut lines of a luminous distribution pattern, there is no need for a shade for forming clear-cut lines.

Further, in a sixth aspect of the invention, the linear light-blocking sections for forming clear-cut lines provided on the left and right lateral surfaces of the shroud glass are constituted by infrared light/visible light blocking films extending in the form of strings.

A luminous distribution having sharp clear-cut lines can be formed by forming the linear light-blocking sections for forming clear-cut lines of a luminous distribution pattern using infrared light/visible light blocking films which can be formed with high accuracy compared to infrared transmitting films.

In a seventh aspect of the invention, the discharge bulb may be used as a light source of a reflection type headlamp for forming a predetermined luminous distribution with light reflected by a reflector provided behind the same. Infrared transmitting films applied to the shroud glass are applied in regions of the shroud glass other than a region associated with an effecting reflecting surface of said reflector contributing to the formation of the luminous distribution.

Visible light included in light exiting the sealed glass bulb that is a light-emitting discharge section passes through regions of the shroud glass where the infrared transmitting films are not applied, and it is reflected forward by the effective reflecting surface of the reflector to form a predetermined luminous distribution. Infrared light included in the light exiting the sealed glass bulb that is a light-emitting discharge section exits the shroud glass in all regions thereof without being blocked by the infrared transmitting films on the shroud glass, which improves radiation of the arc tube.

BRIEF DESCRIPTION OF THE DRAWINGS

FIG. 2(*b*) is a cross sectional view of the arc tube (sectional view taken along the line II—II shown in FIG. 2(*a*)).

DETAILED DESCRIPTION OF THE PREFERRED EMBODIMENTS

Figure 1:
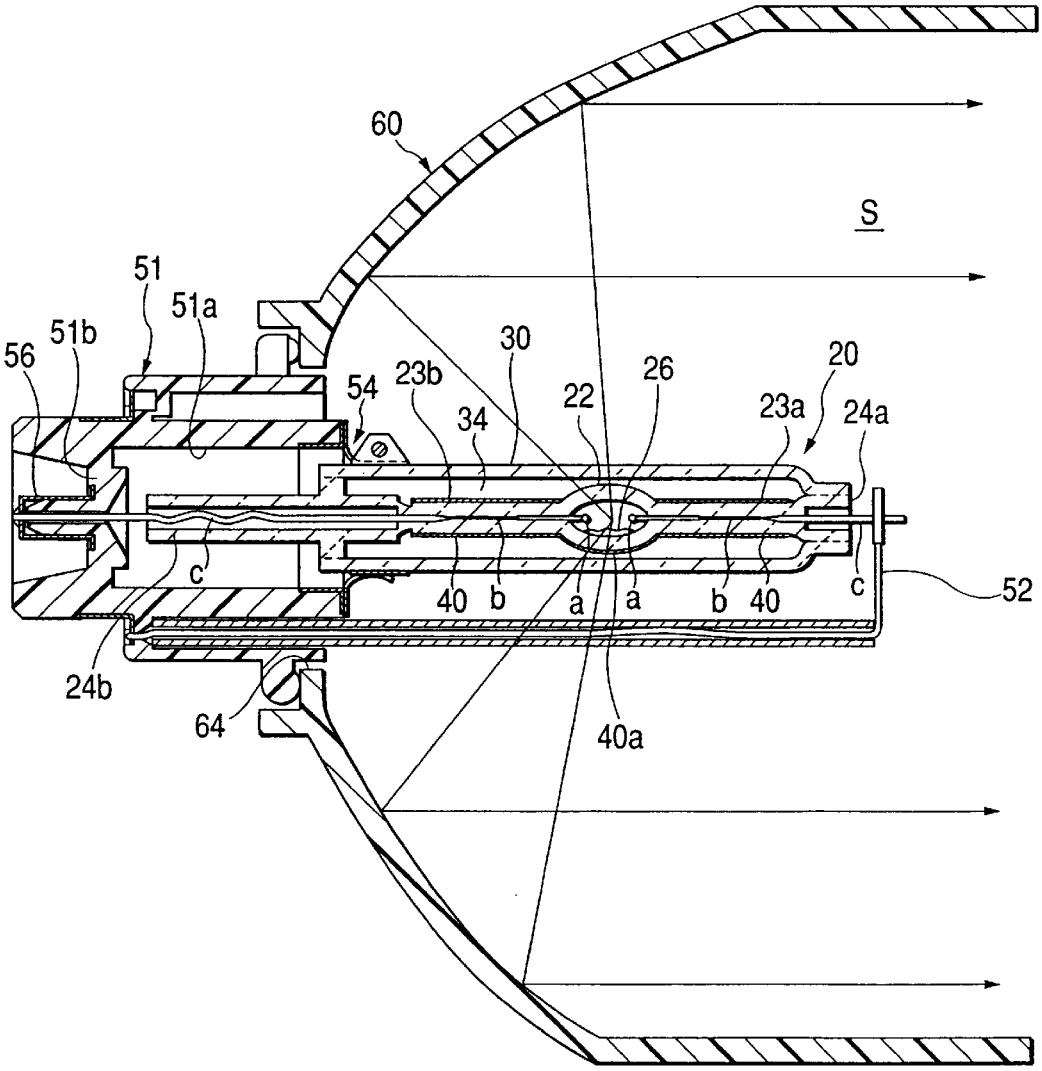
FIG. 1 is a vertical sectional view of a discharge bulb of an embodiment of the invention inserted in a reflector for forming a driving beam from an automobile headlamp.
Figure 2A:
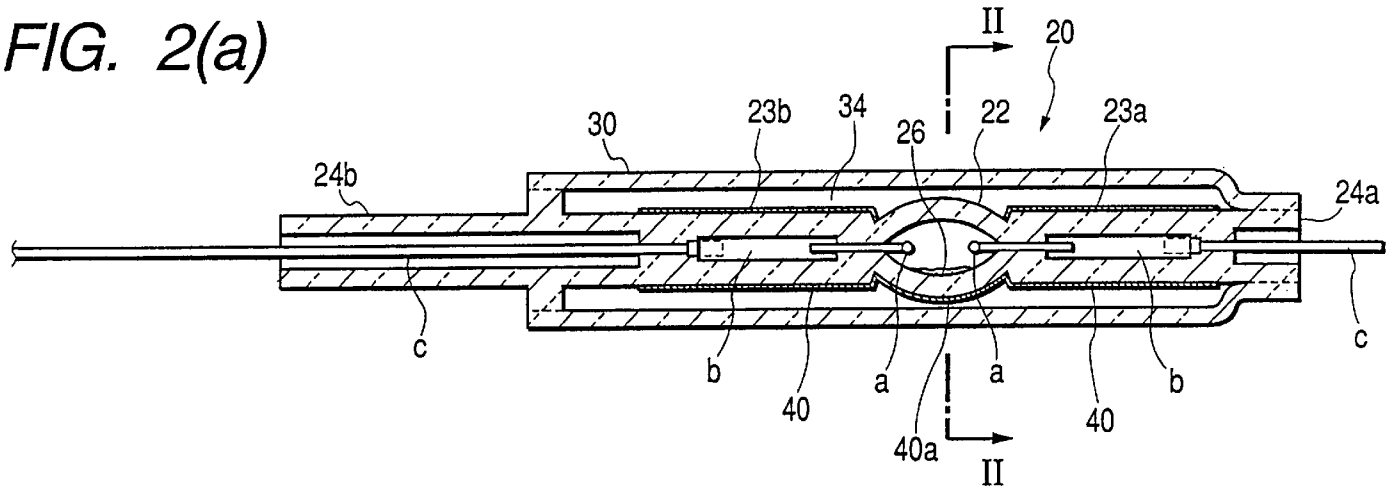
FIG. 2(*a*) is a horizontal sectional view of an arc tube of a discharge bulb.
Figure 2B:
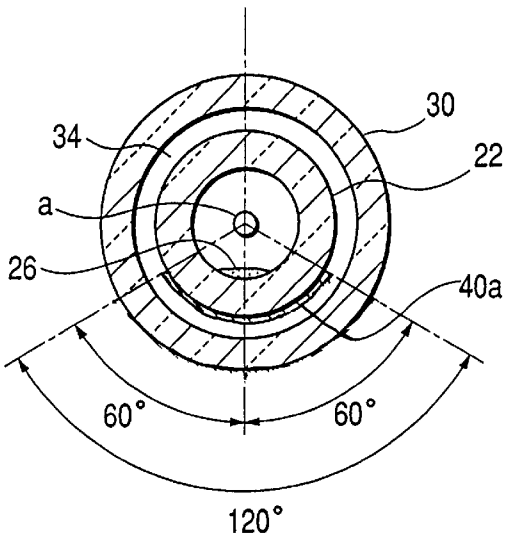
Figure 3:
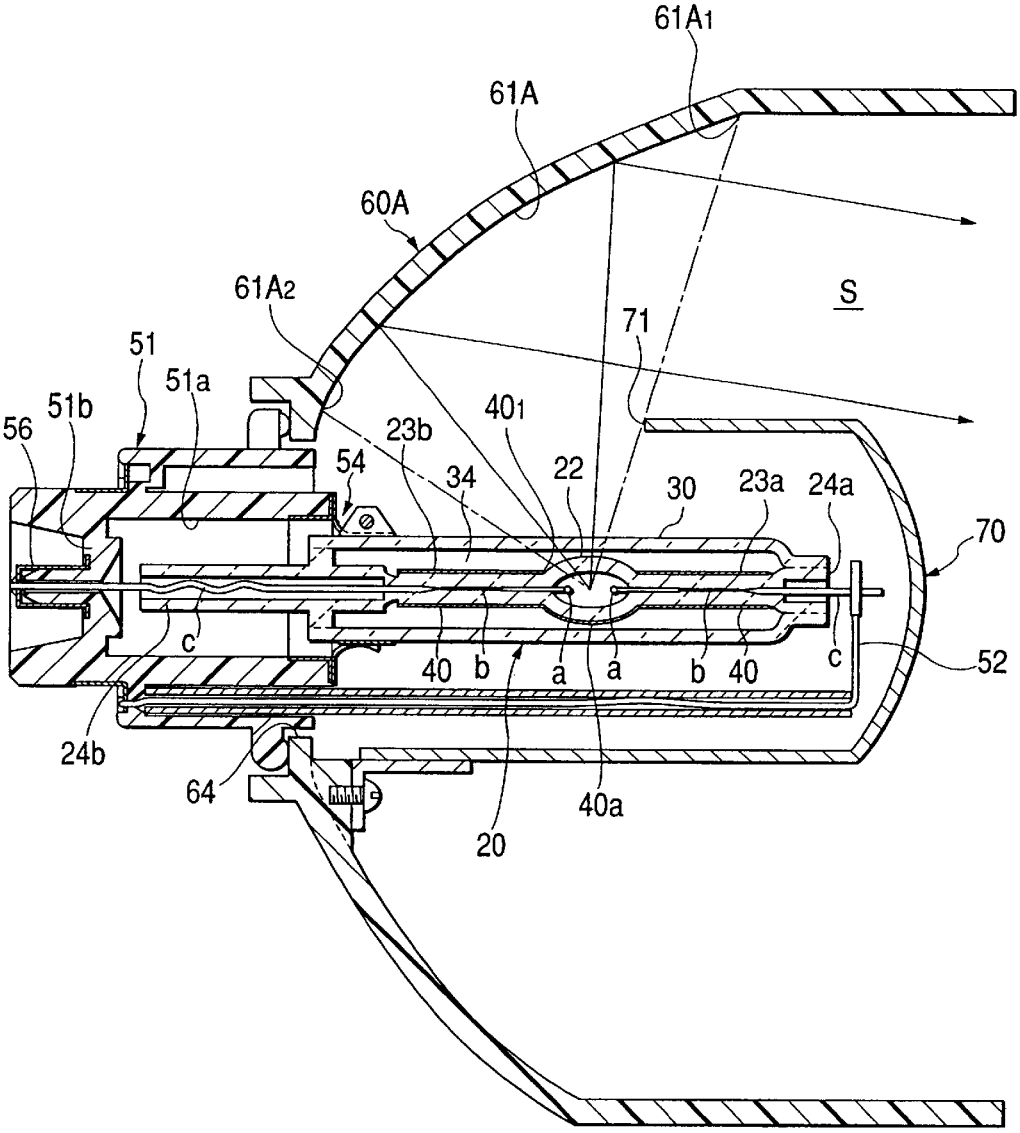
FIG. 3 is a vertical sectional view of the discharge bulb inserted in a reflector for forming a meeting beam.

Embodiments of the present invention will now be described using the aforementioned drawings. FIGS. 1 through 3 show a first embodiment of the invention. In FIGS. 1 through 3, an arc tube 20 is a structure in which a sealed glass bulb 22 as a light-emitting discharge section is formed in the middle of a glass tube in the longitudinal direction thereof; pinch seal portions 23*a* and 23*b* having a rectangular cross section are formed before and behind the sealed glass bulb 22; and cylindrical portions 24*a* and 24*b* that are non-pinch-seal portions extend before and behind the cylindrical portions 24*a* and 24*b*, respectively. The structure as a whole has a rod-like configuration.

Electrodes a, a are provided in a face-to-face relationship in the sealed glass bulb 22 that is sealed with the pinch seal portions 23*a* and 23*b*, and substances such as a rare gas for starting, mercury and a metal halide may be enclosed in the bulb 22. Lead wires c, c connected to molybdenum foils b, b are extracted from the pinch seal portions 23*a* and 23*b* on both ends of the sealed glass bulb 22 and are extended through the cylindrical portions 24*a* and 24*b* in the longitudinal direction thereof.

Front and rear ends of a cylindrical shroud glass 30 for blocking ultraviolet light are integrally joined, for example, by welding to the cylindrical portions 24*a* and 24*b* of the arc tube 20 to provide a structure in which the sealed glass bulb 22 and the pinch seal portions 23*a* and 23*b* are covered with the shroud glass 30. As a result, ultraviolet light in a waveband harmful to human bodies is eliminated from light emitted by the sealed glass bulb 22, and broken pieces of the glass do not spread even in the case of an explosion of the sealed glass bulb 22.

Further, the shroud glass 30 forms a sealed space 34 that is isolated from the atmosphere and is formed around the arc tube 20 (sealed glass bulb 22). The sealed space 34 is evacuated and charged with argon gas having a minimized moisture concentration, and the pressure in the sealed space 34 is adjusted to about 0.5 atm when the arc tube is off (at the normal temperature) such that the pressure will be about 1 atm when the arc tube is on or when it is at a high temperature. Since this ensures air-tightness of the sealed space 34 in which substantially no moisture exists, there is no possibility of devitrification of the arc tube.

Infrared transmitting films 40 for blocking visible light and transmitting infrared light are applied to outer surfaces of the pinch seal portions 23*a* and 23*b* of the arc tube 20 having a rectangular cross section to prevent visible light from exiting the pinch seal portions 23*a* and 23*b*. The infrared transmitting films 40 may be formed by, for example, depositing a titanium oxide layer, silica layer and the like to provide the property of transmitting infrared light while blocking visible light. Of course, other ways of creating the transmitting films are not limited to those described.

Since the quantity of light emitted by the sealed glass bulb 22 of the arc tube 20 in the discharge bulb is much greater than that of an incandescent bulb, a large quantity of light is guided to the pinch seal portions 23*a* and 23*b* due to a light guide effect. The light guided to the pinch seal portions can exit the pinch seal portions 23*a* and 23*b* as a result of reflection at the molybdenum foils b, b or the like and can be reflected forward by the reflector 60 to produce glare. However, since the infrared transmitting films 40 applied to the outer surfaces of the pinch seal portions 23*a* and 23*b* absorb and block visible light that otherwise exits the pinch seal portions 23*a* and 23*b*, no light exits the pinch seal portions 23*a* and 23*b*.

Further, since the infrared transmitting films 40 allow infrared light to pass, infrared light exiting the pinch seal portions 23*a* and 23*b* is transmitted by the infrared transmitting films 40 without being blocked, which prevents accumulation of heat in the pinch seal portions 23*a* and 23*b*.

Therefore, the temperature of the pinch seal portions 23*a* and 23*b* and the sealed glass bulb 22 does not increase excessively, which prevents problems attributable to a temperature rise at the arc tube.

The arc tube 20 is provided such that it horizontally extends into a lighting chamber S of a vehicle headlamp in the fore and aft direction as shown in FIG. 1, and an infrared transmitting film 40*a* may also be applied to the bottom of the sealed glass bulb 22 provided in the lighting chamber of the arc tube to prevent colored light other than white light from exiting the sealed glass bulb 22 downward.

Specifically, since substances such as mercury and a metal iodide may be enclosed in the sealed glass bulb 22 in a saturated state, a yellow liquid enclosed substance 26 may become deposited on the bottom of the sealed glass bulb 22. As a result, light exiting the sealed glass bulb 22 downward becomes yellow light that has the color of the enclosed substance, and as such, the yellow light is mixed with the white light that should be emitted by the sealed glass bulb 22. This effect, of course, degrades the performance of the lamp, which is not preferable. Since the infrared transmitting film 40*a* provided on the bottom of the sealed glass bulb 22 prevents the yellow-colored light from exiting the sealed glass bulb 22, only the white light exits the arc tube 20 (sealed glass bulb 22). Further, since infrared light is transmitted by the infrared transmitting film 40*a*, a large increase of the temperature of the sealed glass bulb 22 can be prevented by providing the infrared transmitting film 40*a* on the sealed glass bulb 22.

The infrared transmitting film 40*a* may be provided in a range covering the bottom and left and right lateral surfaces at an angle of 120 deg. (60 deg. each for the left and right surfaces) as shown in FIG. 2(*b*), and this prevents yellow visible light from exiting the sealed glass bulb 22 downward.

As shown in FIG. 1, the discharge bulb is comprised of the arc tube 20 and an insulated base 51 for supporting the arc tube 20. The front end of the arc tube 20 is supported by a single lead support 52 that protrudes in front of the insulated base 51, and the rear end of the arc tube 20 is gripped by a metal support member 54 secured to a front face of the insulated base 51, which integrally secures the arc tube 20 to the insulated base 51.

A front end lead wire c extracted from the arc tube 20 is secured to the lead support 52 through welding, and a rear end lead wire c is extended through a bottom wall 51*b* formed with a recess 51*a* and secured to a terminal 56 provided on the bottom wall 51*b* through welding. Of course, while welding is described in this embodiment, other means for securing the lead wire may be used without departing from the scope of the invention.

When the discharge bulb is inserted in a bulb insertion hole 64 of a reflector 60 for forming a driving beam of an automobile headlamp, light emitted by the arc tube 20 (sealed glass bulb 22) is reflected forward by the reflector 60 to form a white driving beam.

FIG. 3 shows a case in which the discharge bulb is used as a light source of a meeting beam from an automobile headlamp.

A shade 70 for controlling a luminous distribution is disposed under the discharge bulb such that it covers lower, front, and upper front regions of the arc tube 20. An upper rear edge 71 of the shade 70 agrees with an upper parting line 61A1 of an effective reflecting surface 61A, and a front edge $\mathbf{40}_1$ of the rear side infrared transmission film 40 agrees with a lower parting line 61A2 around the bulb insertion hole 64 of the effective reflecting surface 61A. Further, the shade 70 is formed with linear light-blocking sections (not shown) for forming clear-cut lines.

As a result, light exiting the sealed glass bulb 22 is restricted (blocked) by the infrared transmitting film on the rear side of the arc tube and the shade 70, and is guided to the effective reflecting surface 61A. The light is then reflected by the effective reflecting surface 61A forward to form a white meeting beam having predetermined clear-cut lines.

While the infrared transmitting film 40*a* is applied to the bottom of the sealed glass bulb 22 to prevent yellowish visible light from exiting the sealed glass bulb 22 downward in the above-described embodiment, it is not essential to provide the infrared transmitting film 40*a* on the bottom of the sealed glass bulb 22 when the discharge bulb is used as a light source for forming a driving beam (see FIG. 1).

Specifically, although yellowish light certainly exits the sealed glass bulb 22 downward if the infrared transmitting film 40*a* is not provided, the yellow color is substantially unnoticeable in the luminous distribution and creates no problem in forming a driving beam because it is mixed with white light which exits the sealed glass bulb 22 in directions other than the downward direction and which is reflected and distributed by the reflector 60.

Figure 4:
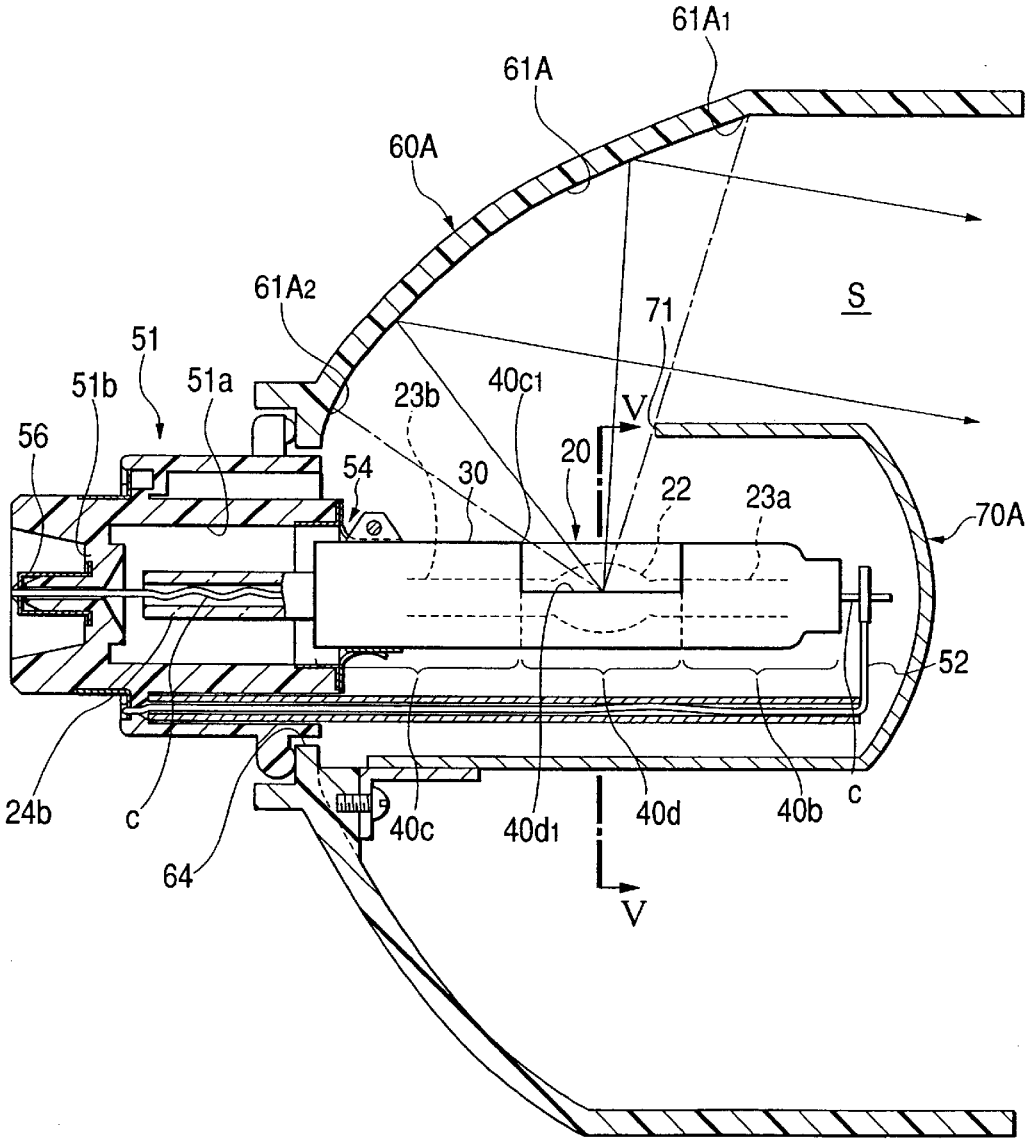
FIG. 4 is a vertical sectional view of a discharge bulb of another embodiment of the invention inserted in a reflector for forming a meeting beam from an automobile headlamp.
Figure 5:
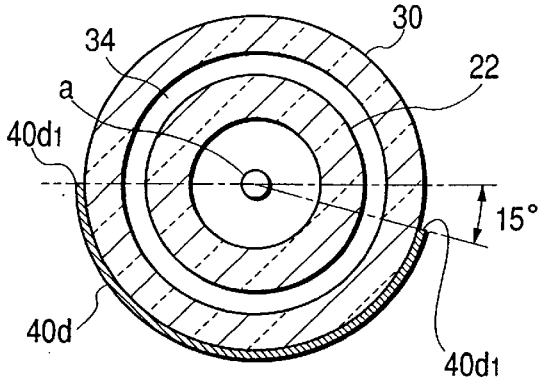
FIG. 5 is a cross sectional view of an arc tube of the discharge bulb (sectional view taken along the line V—V shown in FIG. 4).

FIGS. 4 and 5 show a second embodiment of the invention. FIG. 4 is a vertical sectional view of a discharge bulb as a second embodiment of the invention inserted in a reflector for forming a meeting beam from an automobile headlamp. FIG. 5 is a cross sectional view of an arc tube of the discharge bulb (sectional view taken along the line V—V shown in FIG. 4).

While the infrared transmitting films 40 and 40*a* are applied to outer surfaces of the pinch seal portions 23*a* and 23*b* of the arc tube 20 and across the bottom and lateral surfaces of the sealed glass bulb 22 in the above-described first embodiment, in the second embodiment, infrared transmitting films 40*b* and 40*c* may be applied to the front end and rear end of the shroud glass 30 in association with the pinch seal portions 23*a* and 23*b* of the arc tube instead of providing the infrared transmitting films 40 and 40*a* on the arc tube 20. Therefore, visible optical components of light that have exited the pinch seal portions 23*a* and 23*b* of the arc tube are blocked by the infrared transmitting films 40*b* and 40*c* on the shroud glass 30.

An infrared transmitting film 40*d* may also be applied between the front and rear infrared transmitting films 40*b* and 40*c* to substantially cover the lower half of the shroud glass 30, and visible optical components of yellow light which exit the sealed glass bulb 22 downward are blocked by the infrared transmitting film 40*d*.

A front edge 40*cl* of the rear side infrared transmitting film 40*c* agrees with a lower parting line 61A2 of a bulb insertion hole 64 of an effective reflecting surface 61A of a reflector 60A. Further, the infrared transmitting film 40*d* contributes to the formation of clear-cut lines of a meeting beam that is formed by light reflected by an upper effective reflecting surface 61A of the reflector 60A.

Specifically, the infrared transmitting films 40*b*, 40*c* and 40*d* are applied to the entire region of the shroud glass 30 excluding the rectangular region associated with the sealed glass bulb 22 at the upper side of the same; light (visible light) emitted by the sealed glass bulb 22 exits the shroud glass 30 through the rectangular region where no infrared transmitting film is formed; and the light (visible light) is guided by a shade 70A only to the effective reflecting surface 61A of the reflector 60A. However, unlike the shade 70 described in the first embodiment, the shade 70A is formed with no linear light-blocking sections for forming clear-cut lines of a luminous distribution pattern. Instead, a longitudinally extending linear upper edge 40*dl* of the infrared transmitting film 40*d* provided on the bottom of the shroud glass 30 substantially in the middle thereof in the longitudinal direction may serve as a part for forming clear-cut lines of a meeting beam. In other words, the upper edge 40*dl* of the infrared transmitting film 40*d* that extends from a bottom surface of the shroud glass 30 facing the sealed glass bulb 22 to left and right lateral surfaces of the same is provided in a position associated with clear-cut lines of a meeting beam.

The second embodiment is otherwise the same as the first embodiment, and therefore, like reference numbers are used to avoid repetition of the description.

According to the second embodiment, as thus described, visible optical components of light which have exited the pinch seal portions 23*a* and 23*b* are blocked by the infrared transmitting films 40*b* and 40*c* and are blocked from exiting the shroud glass 30 to prevent glare.

Visible optical components of yellow light which have exited the sealed glass bulb 22 downward can not exit the shroud glass 30, which makes it possible to form an adequate luminous distribution for a meeting beam consisting of only white light as intended.

In the automobile headlamp having a reflector unit shown in FIG. 4, since infrared optical components are distributed in a dark region where no visible light is distributed above clear-cut lines of a luminous distribution pattern of a meeting beam, the region as a dark part above the clear-cut lines which is invisible to naked eyes can be recognized on a monitor by photographing the scene in front of the automobile with an infrared noctovision camera and projecting it on the monitor, which improves safety of driving.

Figure 6:
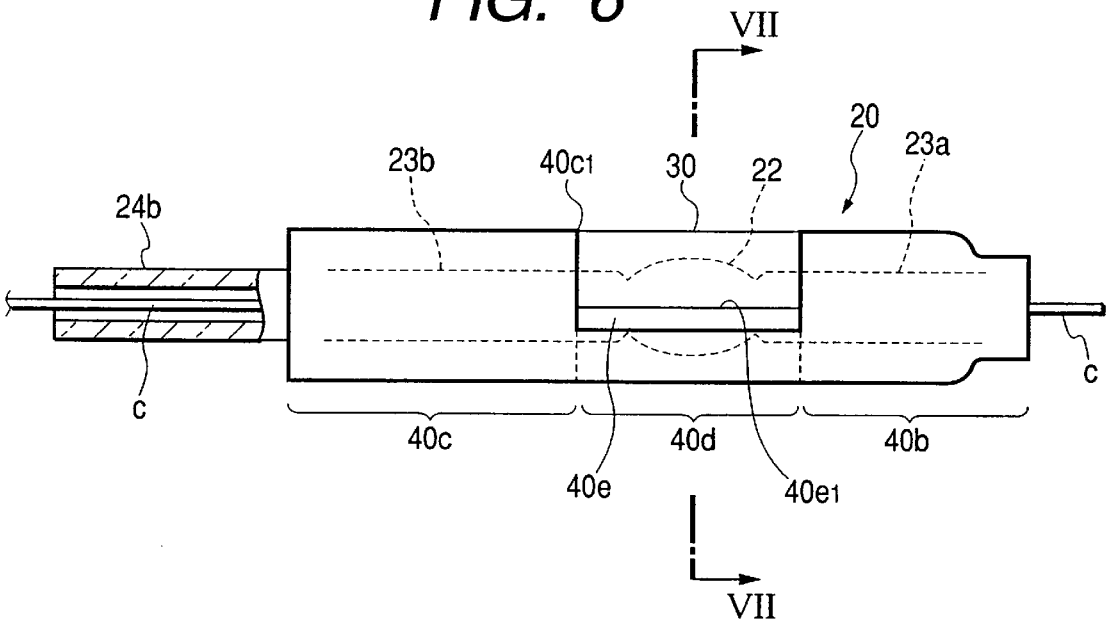
FIG. 6 is a vertical sectional view of an arc tube that is a major part of a discharge bulb that is another embodiment of the invention.
Figure 7:
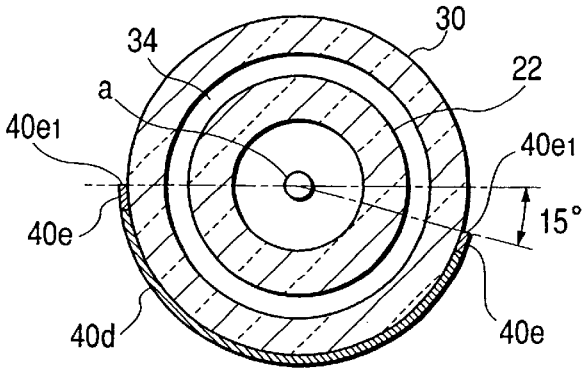
FIG. 7 is a cross sectional view of the arc tube of the discharge bulb (sectional view taken along the line VI—VI shown in FIG. 6).

FIGS. 6 and 7 show a third embodiment of the invention. FIG. 6 is a vertical sectional view of an arc tube which is a major part of a discharge bulb as a third embodiment of the invention, and FIG. 7 is a cross sectional view of the arc tube (sectional view taken along the line VII—VII shown in FIG. 6).

The third embodiment is the same as the second embodiment in that the infrared transmitting films 40*b*, 40*c* and 40*d* are applied to the shroud glass 30 to block visible optical components of light which have exited the pinch seal portions 23*a* and 23*b* of the arc tube with the infrared transmitting films 40*b* and 40*c*, and optical components of yellowish light which have exited the sealed glass bulb 22 downward are blocked with infrared transmitting films 40*e*.

While the linear side edges 40*dl* of the infrared transmitting film 40*d* extending in the longitudinal direction on the left and right lateral surfaces of the shroud glass 30 serve as parts for forming clear-cut lines of a meeting beam in the above-described second embodiment, only string-shaped edge regions along the longitudinally extending linear side edges 40*dl* of this embodiment are constituted by infrared light/visible light blocking films 40*e* in the present embodiment. Specifically, there is provided a configuration in which the infrared transmitting film 40*d* is provided so as to extend from the bottom surface of the shroud glass 30 facing the sealed glass bulb 22 to the left and right lateral surfaces thereof. Also, the infrared light/visible light blocking films 40*e* are provided in the string-shaped edge regions associated with clear-cut lines of a meeting beam, where linear side edges 40*el* of the infrared light/visible light blocking films 40*e* contribute to the formation of clear-cut lines of a meeting beam.

Since the infrared light/visible light blocking films 40*e* can be formed with high accuracy compared to the infrared transmitting film 40*d*, regions associated with clear-cut lines may be formed with accurate linearity, which makes it possible to obtain a luminous distribution having sharp clear-cut lines.

The third embodiment is otherwise the same as the second embodiment shown in FIGS. 4 and 5, and therefore, like reference numbers are used to avoid repetition of the description.

Figure 8:
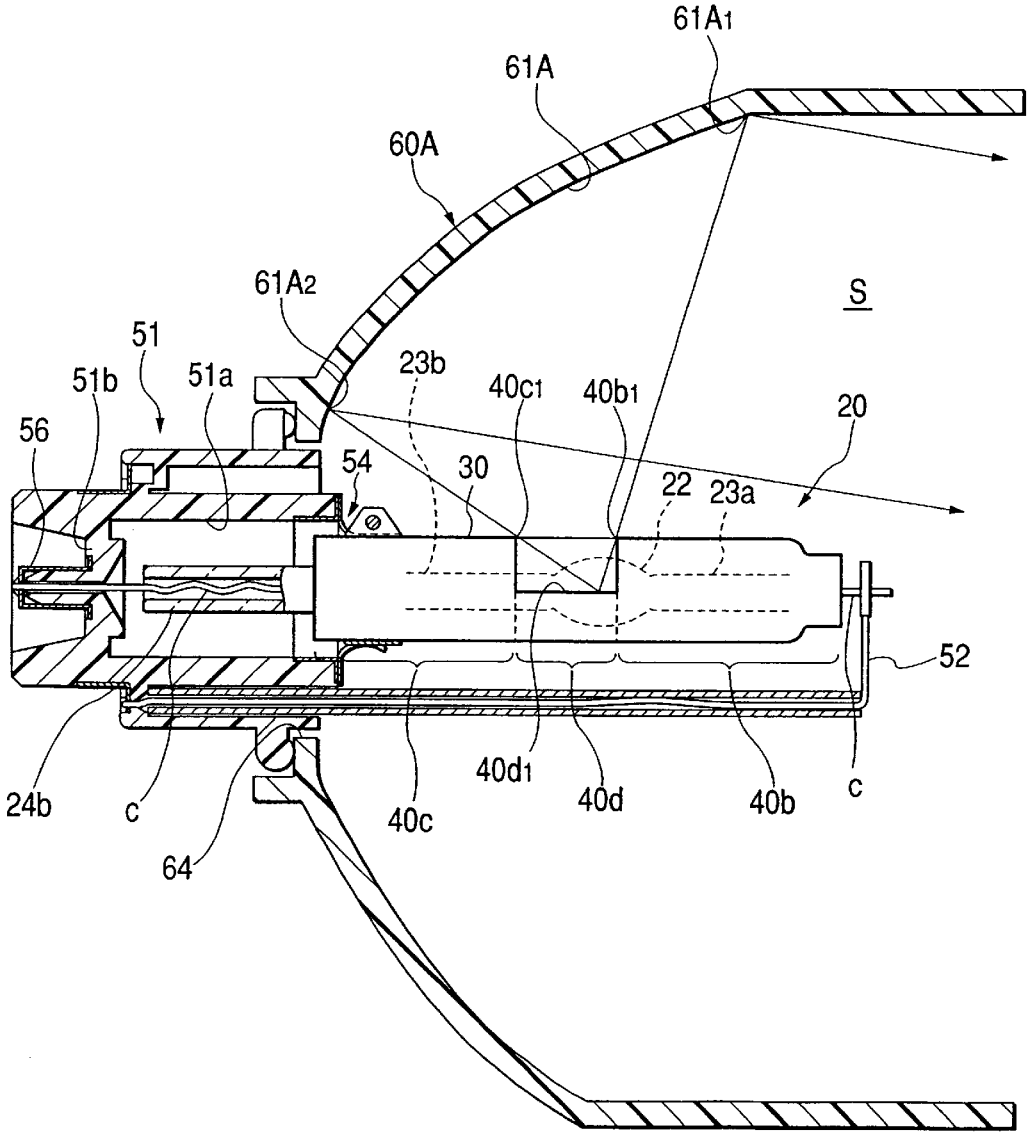
FIG. 8 is a vertical sectional view of a discharge bulb that is a fourth embodiment of the invention inserted in a reflector for forming a meeting beam from an automobile headlamp.
Figure 9:
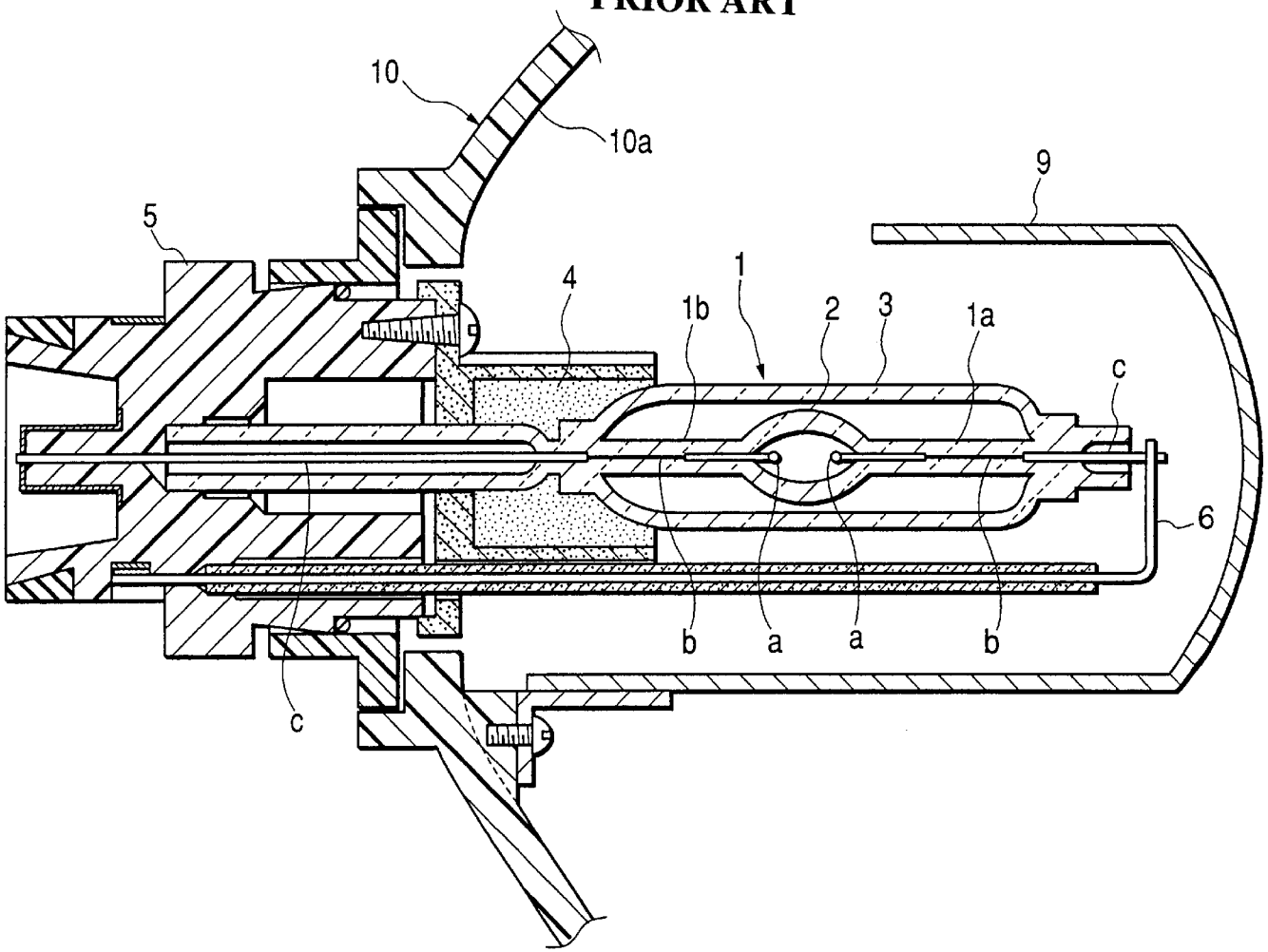
FIG. 9 PRIOR ART
FIG. 9 is a vertical sectional view of a reflector having a discharge bulb according to the prior art inserted therein.

FIG. 8 is a vertical sectional view of a discharge bulb as a fourth embodiment of the invention inserted in a reflector for forming a meeting beam from an automobile headlamp.

The fourth embodiment is similar to the second embodiment in that side edges 40*dl* of a longitudinally extending linear infrared transmitting film on left and right lateral surfaces of a shroud glass serve as parts for forming clear-cut lines of a meeting beam, side edges 40*bl* and 40*cl* before and behind the infrared transmitting films 40*b* and 40*c* associated with the pinch seal portions 23*a* and 23*b* of the arc tube agree with upper and lower parting lines 61A1 and 61A2 of the effective reflecting surface 61A of the reflector 60A respectively to serve as parts for defining light traveling from the sealed glass bulb 22 to the effective reflecting surface 61A.

Therefore, the present embodiment eliminates the need for the shades 70 and 70A for controlling a luminous distribution which are required in the above-described second and third embodiments, which simplifies the configuration of a lighting device.

The embodiment is otherwise the same as the second embodiment, and like reference numbers are used to avoid repetition of the description.

While infrared transmitting films are provided on either arc tube 20 or shroud glass 30 in the first through third embodiments, infrared transmitting films may be provided on both of the arc tube 20 and shroud glass 30. In such a configuration, visible optical components are eliminated two times, i.e., when they exit the arc tube and when they exit the shroud glass, and this completely eliminates the possibility of glare and makes it possible to obtain adequate white light with reliability.

While the above embodiments referred to configurations in which the shroud glass 30 is integrally welded to the arc tube 20, the invention can be equally applied to a discharge bulb having a structure in which an open base section of an ultraviolet blocking shroud glass in the form of a cap having a closed-end that is separate from an arc tube is secured to an insulated base 51 to cover the ac tube and lead support as a whole with the cap type shroud glass.

As apparent from the above description, according a first aspect of the invention, a luminous distribution can be easily controlled because visible light that can produce glare does not exit the pinch seal portions of the arc tube.

Since infrared light that has nothing do to with a luminous distribution is allowed to exit the pinch seal portions of the arc tube, there is no possibility of overheating of the arc tube attributable to accumulation of heat in the arc tube (pinch seal portions and sealed glass bulb).

According to second aspect of the present invention, since light exiting a sealed glass bulb is not affected by the color of enclosed substances deposited on the bottom of the sealed glass bulb, adequate white light can be obtained from the arc tube.

According to a third aspect of the present invention, since no visible light that can produce glare exits the arc tube, control of a luminous distribution is simplified. Especially, when the infrared transmitting films are applied to both of the pinch seal portions and the shroud glass, control of a luminous distribution is further simplified because visible light that can produce glare is reliably prevented.

Since infrared light is allowed to exit the arc tube while visible light that can produce glare is disallowed to exit the same, there is no possibility of overheating of the arc tube attributable to accumulation of heat in the arc tube (pinch seal portions, sealed glass bulb and shroud glass).

In fact, when the infrared transmitting film is applied only to the shroud glass, since the temperature of the shroud glass is lower than the temperature of the pinch seal portions, the infrared transmitting film is less vulnerable to heat, which improves the durability of the infrared transmitting film and makes it possible to use a discharge bulb for a long time.

According to a fourth aspect of the present invention, since light exiting the sealed glass bulb (shroud glass) is not affected by the color of enclosed substances that reside in the sealed glass bulb, adequate white light can be obtained from the arc tube.

According to a fifth aspect of the present invention, since there is no need for a shade for forming clear-cut lines, the configuration of a lighting device can be simplified.

In particular, when the infrared transmitting films are applied to the shroud glass such that infrared light will be distributed to a dark region above clear-cut lines of a luminous distribution pattern, the dark region above the clear-cut lines can be monitored with an infrared noctovision camera. Specifically, even a dark region above the clear-cut lines which is invisible to naked eyes can be recognized on a monitor by photographing the scene in front of the automobile with an infrared noctovision camera and projecting it on a monitor, which improves safety of driving.

According to a sixth aspect of the present invention, since sharp clear-cut lines are formed on a luminous distribution, visibility is improved.

According to a seventh aspect of the present invention, since the infrared transmitting film on the shroud glass serves as a shade for blocking light traveling toward regions other than the effective reflecting surface that contributes to the formation of a luminous distribution of the reflector, there is no need for a shade for controlling a luminous distribution.

What is claimed is:

1. A discharge bulb comprising:

an arc tube including a sealed bulb as a light emitting discharge section formed with pinch seal portions at both ends thereof; and infrared transmitting film operable to block visible light and transmit infrared light applied to at least the pinch seal portions of the arc tube;

wherein the arc tube includes a region for transmitting visible light where no infrared transmitting film is applied.

2. The discharge bulb according to claim 1, wherein the arc tube is disposed in a lighting chamber of a vehicle light lamp, and the infrared transmitting film is applied to predetermined ranges extending from the bottom of the sealed bulb to left and right lateral surfaces thereof.

3. A discharge bulb comprising:

an arc tube including a sealed bulb as a light emitting discharge section formed with pinch seal portions at both ends thereof;

a cylindrical shroud joined to the arc tube and enclosing and sealing the arc tube; and infrared transmitting film operable to block visible light and transmit infrared light, wherein the infrared transmitting film is applied to at least the pinch seal portions of the arc tube and the arc tube includes a region for transmitting visible light where no infrared transmitting film is applied; and/or the infrared transmitting film is applied to at least regions of the shroud associated with the pinch seal portions and the shroud includes a region for transmitting visible light where no infrared transmitting film is applied.

4. The discharge bulb according to claim 3, wherein the arc tube is disposed in a lighting chamber of a vehicle light lamp, and wherein the infrared transmitting film is applied to predetermined ranges extending from the bottom of the sealed bulb to left and right lateral surfaces thereof and/or in predetermined ranges extending from the bottom of the shroud to left and right lateral surfaces thereof.

5. The discharge bulb according to claim 3, wherein the discharge bulb is used as a light source of a reflection type vehicle light lamp for forming a predetermined luminous distribution pattern with light reflected by a reflector provided behind the discharge bulb, and wherein the infrared transmitting film is applied to left and right lateral surfaces of the shroud and serves as linear light-blocking sections for forming clear-cut lines of the luminous distribution pattern.

6. The discharge bulb according to claim 4, wherein the discharge bulb is used as a light source of a reflection type vehicle light lamp for forming a predetermined luminous distribution pattern with light reflected by a reflector provided behind the discharge bulb, and wherein the infrared transmitting film is applied to the left and right lateral surfaces of the shroud and serves as linear light-blocking sections for forming clear-cut lines of the luminous distribution pattern.

7. The discharge bulb according to claim 5, wherein the linear light-blocking sections for forming the clear-cut lines provided on the left and right lateral surfaces of the shroud are constituted by infrared light/visible/light blocking film extending in the form of strings.

8. The discharge bulb according to claim 6, wherein the linear light-blocking sections for forming the clear-cut lines provided on the left and right lateral surfaces of the shroud are constituted by infrared light/visible/light blocking films extending in the form of strings.

9. The discharge bulb according to claim 3, wherein the discharge bulb is used as a light source of a reflection type vehicle light lamp for forming a predetermined luminous distribution pattern with light reflected by a reflector provided behind the discharge bulb, and wherein the infrared transmitting film is applied to regions of the shroud not associated with an effecting reflecting surface of the reflector contributing to the formation of the luminous distribution pattern.

10. The discharge bulb according to claim 1, wherein the arc tube is formed of a glass material.

11. The discharge bulb according to claim 3, wherein the arc tube and the shroud are formed of a glass material.

12. The discharge bulb according to claim 3, wherein the cylindrical shroud is joined to the arc tube by welding.

13. A discharge bulb including infrared transmitting film applied to at least a portion of the discharge bulb and operable to block visible light and transmit infrared light; wherein the discharge bulb includes a region for transmitting visible light where no infrared transmitting film is applied.

14. The discharge bulb according to claim 13, further comprising an arc tube including a sealed bulb as a light emitting discharge section formed with pinch seal portions at both ends thereof; and a cylindrical shroud joined to the arc tube and enclosing and sealing the arc tube.

15. The discharge bulb according to claim 14, wherein the at least a portion of the discharge bulb includes the pinch seal portions of the arc tube and/or predetermined ranges extending from the bottom of the sealed bulb to left and right lateral surfaces thereof.

16. The discharge bulb according to claim 14, wherein the at least a portion of the discharge bulb includes the pinch seal portions of the arc tube and/or predetermined ranges extending from the bottom of the shroud to left and right lateral surfaces thereof.

17. The discharge bulb according to claim 14, wherein the at least a portion of the discharge bulb includes left and right lateral surfaces of the shroud and serves as linear light-blocking sections for forming clear-cut lines of the luminous distribution pattern.

18. The discharge bulb according to claim 14, wherein the at least a portion of the discharge bulb includes predetermined ranges extending from the bottom of the sealed bulb to left and right lateral surfaces thereof and/or predetermined ranges extending from the bottom of the shroud to left and right lateral surfaces thereof.

19. The discharge bulb according to claim 14, wherein the discharge bulb is used as a light source of a reflection type vehicle light lamp for forming a predetermined luminous distribution pattern with light reflected by a reflector provided behind the discharge bulb, and wherein the at least a portion of the discharge bulb includes regions of the shroud not associated with an effecting reflecting surface of the reflector contributing to the formation of the luminous distribution pattern.

* * * * *